US009151100B2

(12) United States Patent
Chao

(10) Patent No.: US 9,151,100 B2
(45) Date of Patent: Oct. 6, 2015

(54) BRACKET DOOR CLOSER

(71) Applicant: Cmech (Guangzhou), Ltd., Guangdong (CN)

(72) Inventor: Wei Jin Chao, Guangdong (CN)

(73) Assignee: Cmech (Guangzhou) Ltd. (CN)

( * ) Notice: Subject to any disclaimer, the term of this patent is extended or adjusted under 35 U.S.C. 154(b) by 0 days.

(21) Appl. No.: 14/606,322

(22) Filed: Jan. 27, 2015

(65) Prior Publication Data

US 2015/0135478 A1 May 21, 2015

Related U.S. Application Data

(63) Continuation of application No. 13/950,522, filed on Jul. 25, 2013, now Pat. No. 9,009,917.

(51) Int. Cl.

| | |
|---|---|
| ***E05F 1/08*** | (2006.01) |
| ***E05F 1/10*** | (2006.01) |
| ***E05F 1/00*** | (2006.01) |

(52) U.S. Cl.

CPC ..... *E05F 1/1066* (2013.01); *E05F 1/002* (2013.01); *E05F 1/1091* (2013.01); *E05Y 2201/214* (2013.01); *E05Y 2201/604* (2013.01); *E05Y 2201/638* (2013.01); *E05Y 2800/22* (2013.01); *E05Y 2800/242* (2013.01); *E05Y 2900/132* (2013.01)

(58) Field of Classification Search

CPC ... Y10T 16/281; Y10T 16/299; Y10T 16/286; Y10T 16/27; Y10T 16/56; Y10T 16/585; Y10T 16/568; E05Y 2900/132; E05F 3/00; E05F 3/104; E05F 3/108; E05F 3/02; E05F 3/04; E05F 3/06; E05F 3/08; E05F 3/22; E05F 1/1016; E05F 1/1091

See application file for complete search history.

(56) References Cited

U.S. PATENT DOCUMENTS

| | | | |
|---|---|---|---|
| 2,102,321 | A | 12/1937 | Keene |
| 2,515,875 | A | 7/1950 | Jones |
| 2,552,821 | A | 5/1951 | Simpson |
| 2,634,454 | A | 4/1953 | Altenburger |
| 2,651,074 | A | 9/1953 | Slopa et al. |
| 2,707,798 | A | 5/1955 | Comey et al. |
| 2,821,737 | A | 2/1958 | Simsich |
| 2,880,450 | A | 4/1959 | Newell |
| 3,161,909 | A | 12/1964 | Strauss |
| 3,538,537 | A | 11/1970 | Strauss |
| 4,141,104 | A | 2/1979 | Watson |
| 5,495,639 | A | 3/1996 | Wartian |
| 5,630,248 | A | 5/1997 | Luca |
| 5,749,122 | A | 5/1998 | Herbst |
| 5,832,562 | A | 11/1998 | Luca |
| 5,842,255 | A | 12/1998 | Luca |
| 5,855,039 | A | 1/1999 | Crawford |
| 6,634,057 | B2 | 10/2003 | Wartian |
| 6,871,381 | B1 | 3/2005 | Luca |
| 6,976,288 | B1 | 12/2005 | Luca |
| 6,976,289 | B1 | 12/2005 | Luca |
| 6,981,295 | B2 | 1/2006 | Duffy |
| 7,055,319 | B1 | 6/2006 | Luca |
| 7,111,359 | B1 | 9/2006 | Luca |
| 7,134,168 | B1 | 11/2006 | Qing |

*Primary Examiner* — Chuck Mah

(74) *Attorney, Agent, or Firm* — McKee, Voorhees & Sease, PLC

(57) ABSTRACT

A door closer is provided to automatically pull a storm or screen door to a fully closed position without user action. The door closer includes a bracket housing with a cam switch movable along a track as the door opens and closes. The closer cylinder rod is engaged with the cam switch until the door is fully opened. The cam switch biases the closer cylinder and rod as the door approaches the closed position.

16 Claims, 17 Drawing Sheets

BRACKET DOOR CLOSER

CROSS REFERENCE TO RELATED APPLICATIONS

This application is a Continuation Application of U.S. Ser. No. 13/950,522 filed Jul. 25, 2013, herein incorporated by reference in its entirety.

FIELD OF THE INVENTION

A door closer assembly is provided for a screen or storm door to automatically fully close the door without user interaction.

BACKGROUND OF THE INVENTION

Storm doors and screen doors have a long-term problem of failure to completely close on their own. Complaints from users and manufacturers indicate that these storm and screen doors do not always automatically close and fully seal shut when relying solely on the closing strength of the standard pneumatic or hydraulic door closer. This problem arises, at least in part, due to the air pocket or space between the primary door and storm door which prevents the outer storm/screen door from fully closing shut. Past attempts to resolve this problem include an air release mechanism which functions as the door closes to release air from the space as the space narrows, though results are inconsistent with this air release system. Also, consumers are hesitant to pay for add-on parts which attempt to fix the problem.

Accordingly, a primary objective of the present invention is the provision of an improved door closer which assures that a storm or screen door will be fully shut and sealed automatically solely by the action of the improved door closer.

Another objective of the present invention is the provision of a door closer which mechanically urges a storm or screen door to a fully closed and sealed position.

Another objective of the present invention is the provision of a storm and screen door closer which is spring biased to a fully closed position.

Yet another objective of the present invention is the provision of a storm and screen door closer having cam action to facilitate complete closure of the door.

Still another objective of the present invention is a provision of a storm and screen door closer which utilizes a pneumatic or hydraulic cylinder in combination with a pivotal cam to facilitate full closure of the door.

Another objective of the present invention is the provision of an improved storm and screen door closer which assures complete closure of the door without user effort.

A further objective of the present invention is the provision of an improved storm and screen door closer which is economical to manufacture, and durable and safe in use.

These and other objectives will become apparent from the following description of the invention.

SUMMARY OF THE INVENTION

The storm and screen door closure of the present invention includes a bracket fixed on the door jamb and a pneumatic or hydraulic cylinder fixed to the storm or screen door. The bracket includes a cam switch which is slidably and pivotally mounted in the bracket. The hydraulic cylinder includes a rod having an outer end slidably received in a slot in the cam switch so as to be engaged in the cam switch when the door is closed and disengaged from the cam switch when the door is fully opened. The cam switch is spring biased so as to urge the cylinder rod to a retracted position and thereby fully close the door.

As the storm or screen door is opened, the outer end of the cylinder rod slides and pivots the cam switch until the rod is disengaged from the cam switch. As the door begins to close, the end of the rod re-engages with the cam switch. A spring connected to the cam switch pulls the cam switch so as to retract the rod and fully close the storm or screen door.

DETAILED DESCRIPTION OF THE PREFERRED EMBODIMENTS

The door closer 10 of the present invention includes a bracket assembly 12 and a pneumatic or hydraulic cylinder 14 with an extensible and retractable rod 16 extending between the bracket assembly 12 and the cylinder 14. The cylinder 14 and rod 16 create a linear actuator for facilitating closure of the door.

Figure 1:
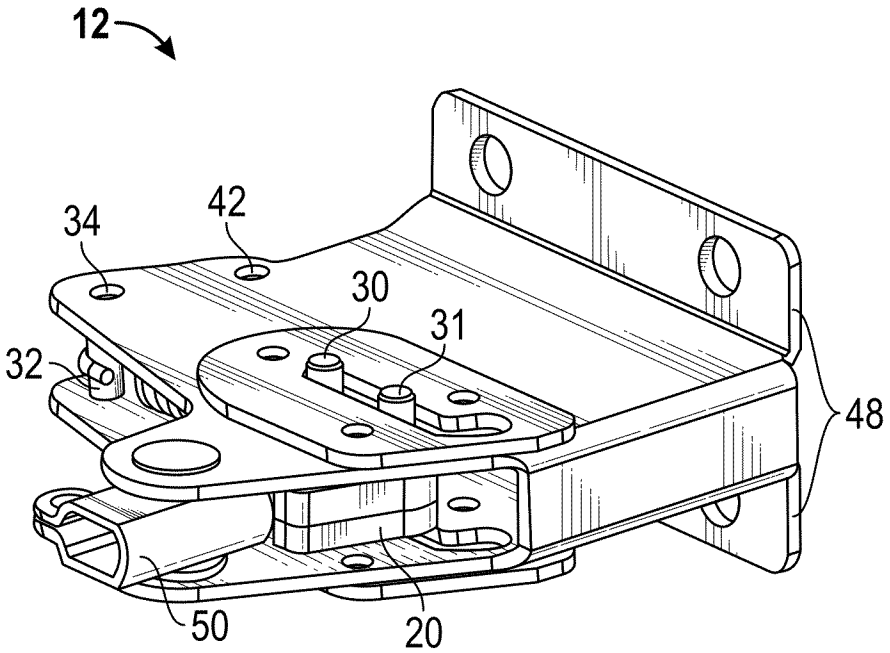
FIG. 1 is a perspective view of the bracket door closer of the present invention.
Figure 2:
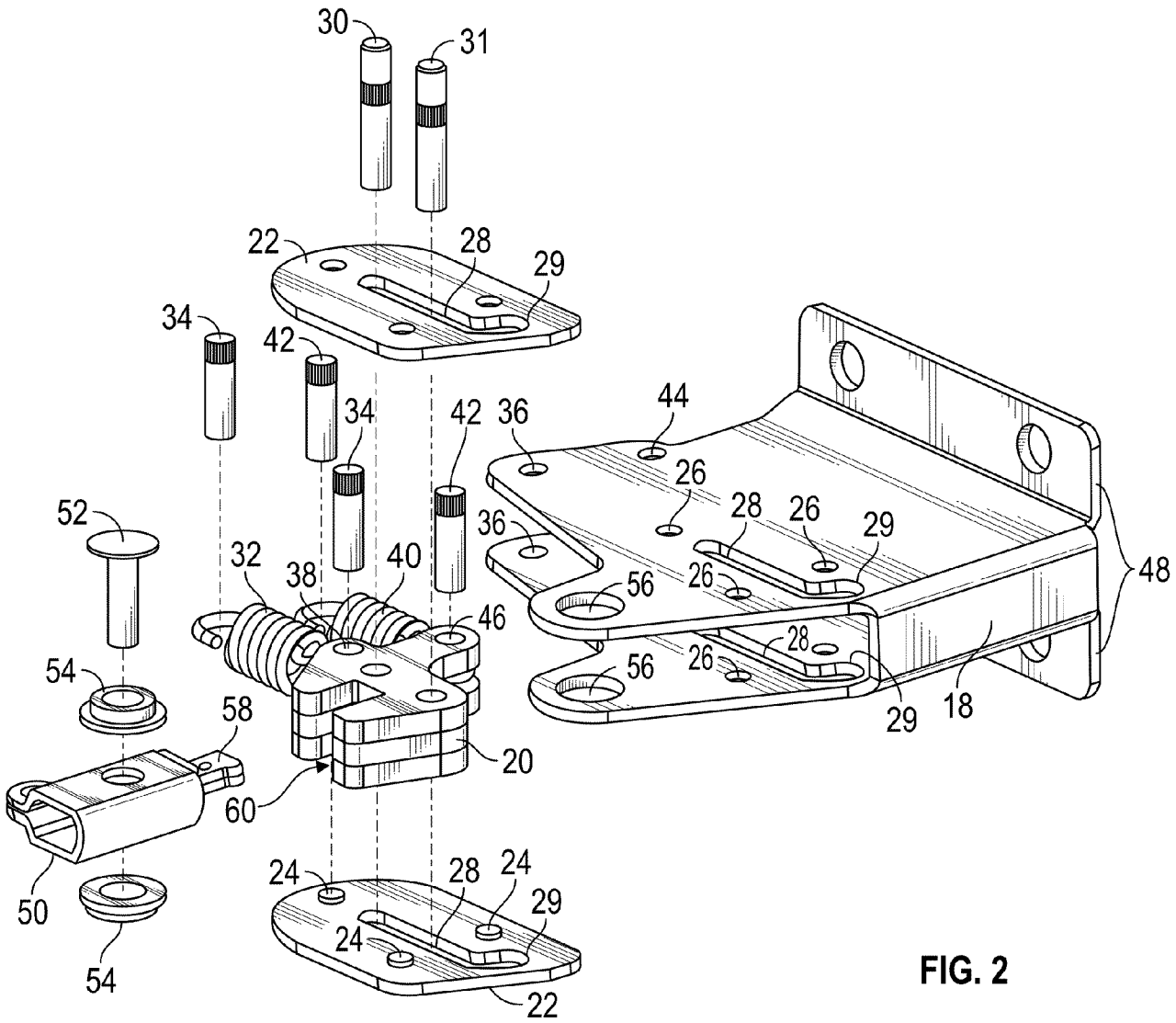
FIG. 2 is an exploded view of the bracket door closer of the present invention.
Figure 3A:
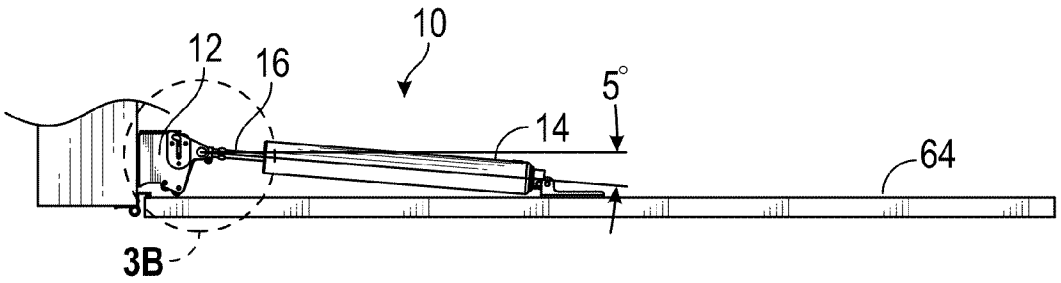
FIG. 3A is a top plan view of the bracket door closer mounted to a door jamb or frame and a screen or storm door, with the bracket door being in a fully closed position.
Figure 3B:
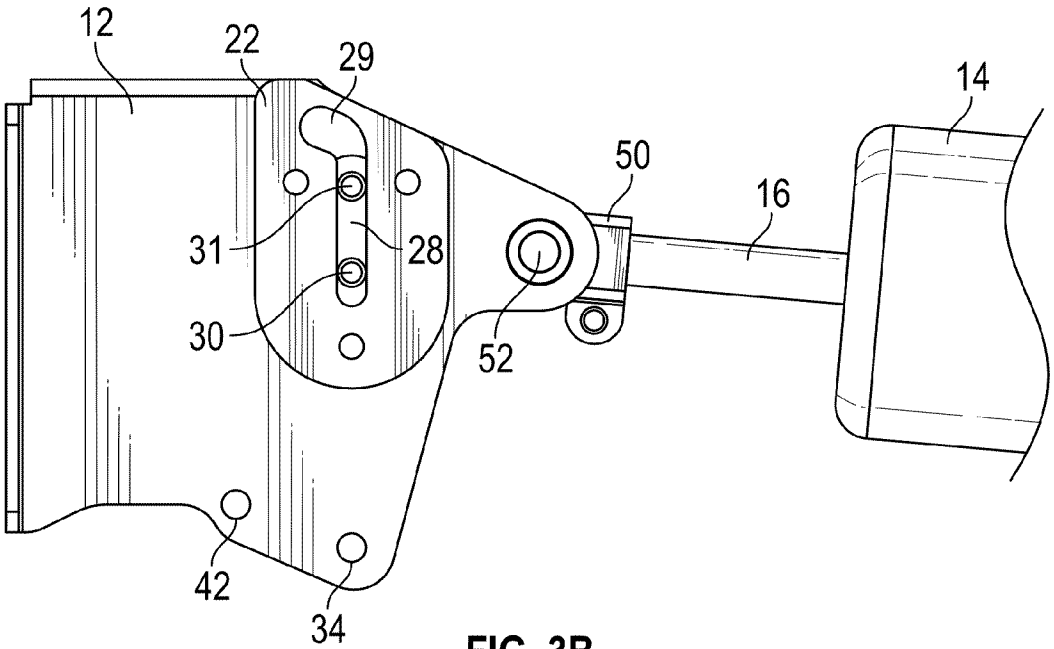
FIG. 3B is an enlarged plan view of the bracket door closer and cylinder rod when the door is fully closed.
Figure 3C:
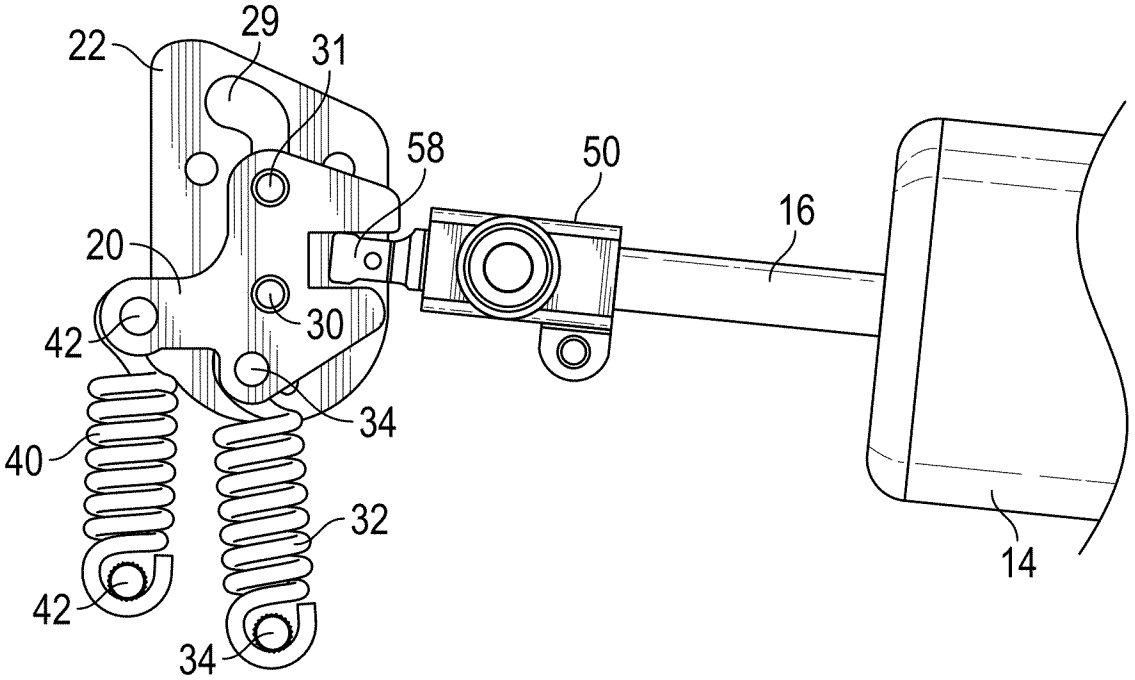
FIG. 3C is a view similar to FIG. 3B showing the position and relationship between the cam switch and the closer rod when the door is fully closed.

The bracket assembly 12 includes a housing 18 with a pivotal and slidable cam switch 20. More particularly, a pair of track plates 22 are mounted on opposite sides of the housing 18 in any convenient manner. For example, as shown in FIG. 2, the track plate 22 include stubs 24 which are press fit into holes 26 on the bracket housing 18. The track plates 22 and the opposite sides of the housing 18 include an elongated slot 28 with an angled head 29. The cam switch 20 resides between the opposite sides of the housing 18 and is slidable along the slots 28 via mounting pins 30, 31. The cam switch 20 is biased to the outer ends of the slots 28 opposite the head 29 by a spring 32. The spring 32 is mounted at opposite ends to the bracket housing 18 and to the cam switch 20 by pins 34 which extends through holes 36 in the bracket housing 18 and through a hole 38 in the cam switch 20.

A second spring 40 is offset from the first spring 32. The spring 32 is connected to the bracket housing 18 and to the switch plate 20 by pins 42 extending through holes 44 in the bracket housing 18 and a hole 46 in the switch plate 20. As discussed in more detail below, when the screen or storm door is fully opened, the spring 42 retains the switch plate at the inner end of the slot head 29.

The bracket assembly 12 also includes a rod insert 50. The insert 50 has an open end to receive the outer end of the cylinder rod 16 which is retained in the insert 50 by a pin 52. The pin 52 also extends through bushings 54 mounted in holes 56 in the bracket housing 18, such that the rod insert 50 is pivotally mounted to the housing 18. The rod insert 50 also has a free end 58 which is slidably received in a recess or notch 60 in the cam switch 20. The insert 50 forms an extension on the end of the rod 16.

The bracket housing 18 includes opposite flanges 48 for mounting the housing 18 to a door frame or jamb 62. The cylinder 14 is pivotally mounted to the storm or screen door 64 in a conventional manner.

FIGS. 3-8 show a series of movements for the door 64 and door closer 10. In FIGS. 3A-3C, the door 64 is fully closed. The cylinder 14 and rod 16 extend at an angle of approximately 5 degrees from the plane of the door, when the door is closed. In the door closed position, the end 58 of the rod insert 50 is received in the notch 60 of the cam switch 20, as shown in FIG. 3C. The cam switch 20 is in a closed position and is biased to the outer end of the slot 28 by the spring 32.

Figure 4A:
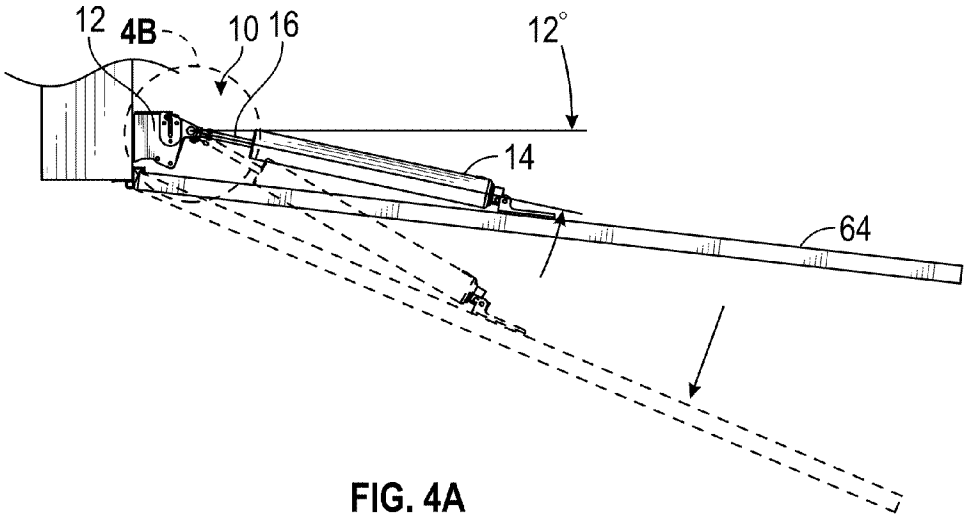
FIGS. 4A-4C are similar to FIGS. 3A-3C, but showing the door in an initial opening position, and with the broken lines showing continued opening of the door.
Figure 4B:
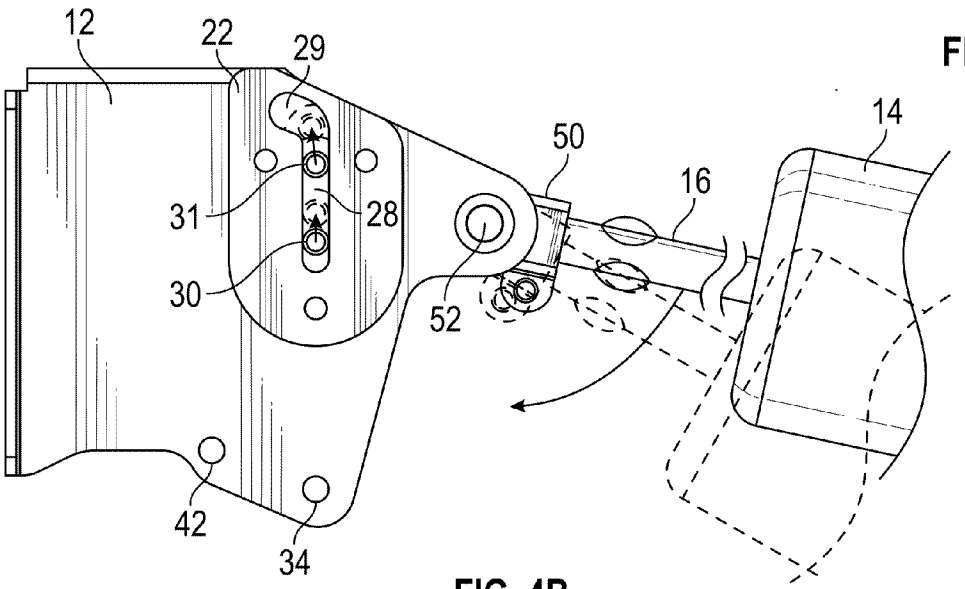
Figure 4C:
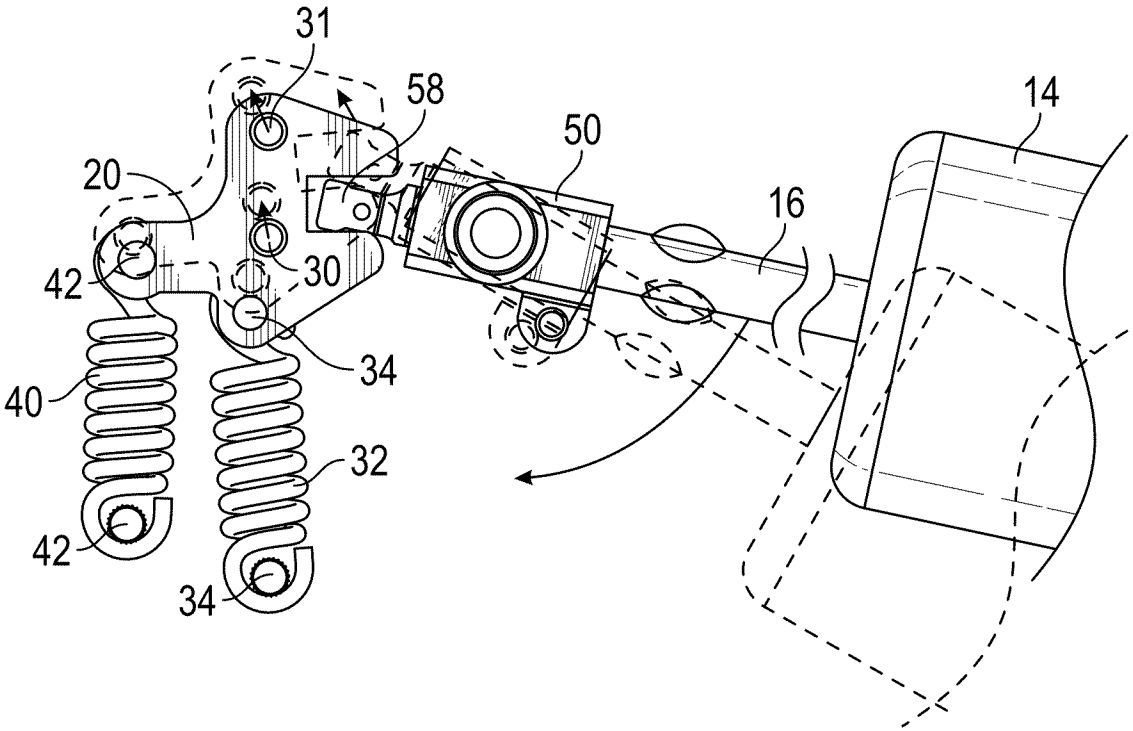
Figure 5A:
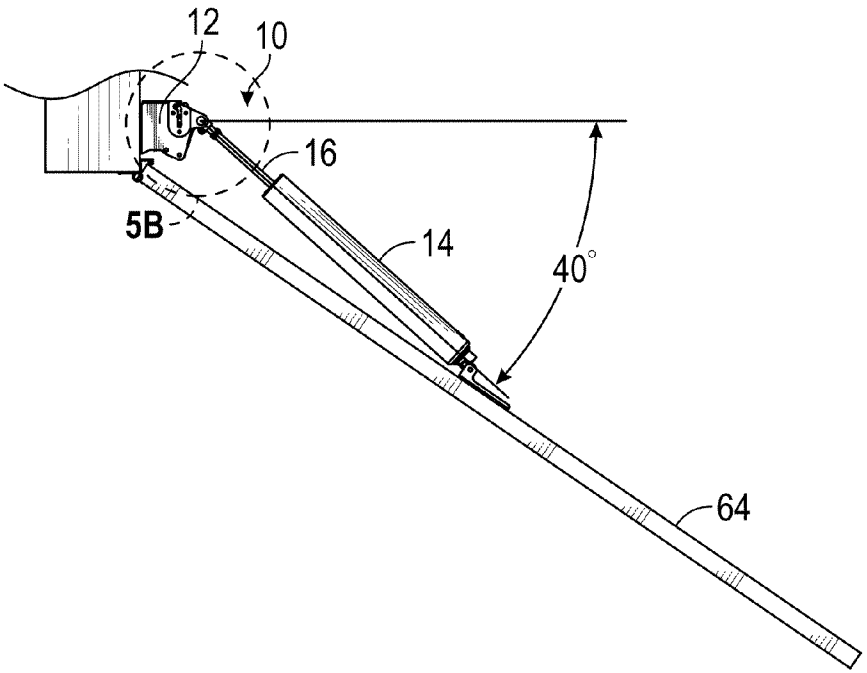
FIGS. 5A-5C are similar to FIGS. 4A-4C, but with the door opened further.
Figure 5B:
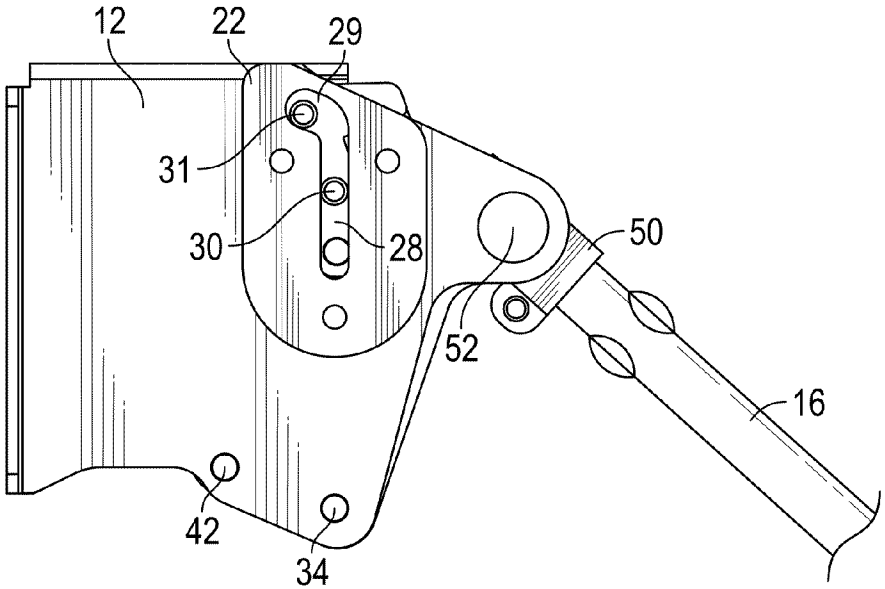
Figure 5C:
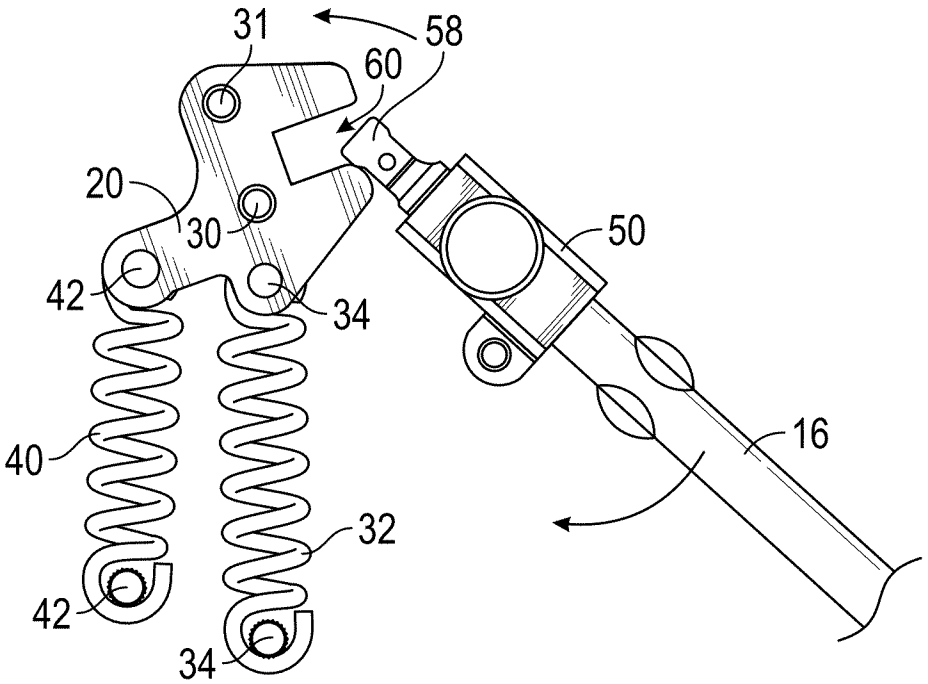

As the door 64 begins to open, as shown in FIGS. 4A-4C, the rod 16 begins to retract from the cylinder 14 and the cam switch 20 moves inwardly along the slot 28 of the bracket housing 18 and track plates 22, as seen in FIGS. 4B and 4C.

As the opening movement of the door 64 continues (FIGS. 5A-5C), the end 58 of the insert 50 moves out of the notch 60 of the cam switch 20, and the cam switch 20 continues to move inwardly in the slots 28. The second spring 40 pivots the cam switch 20 so that the second pin 31 moves into the head 29 of the slots 28.

Figure 6B:
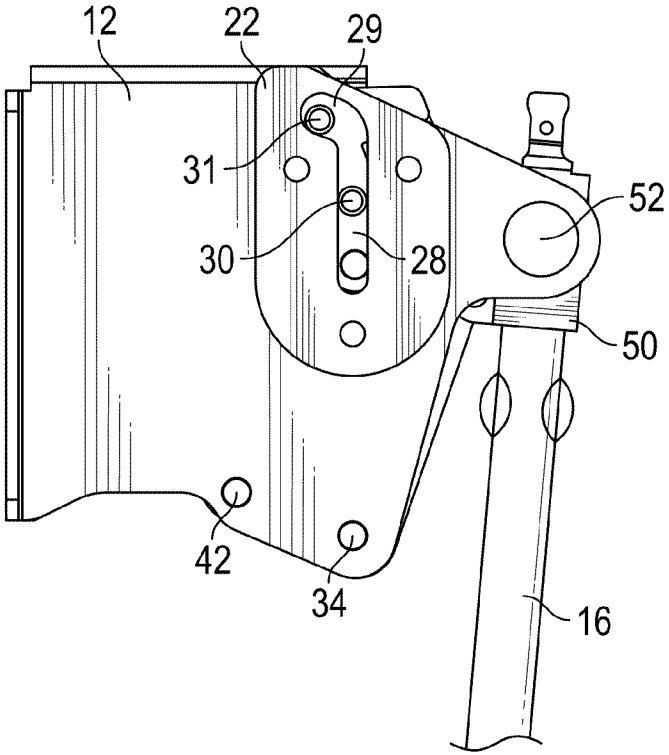
FIGS. 6A-6C are similar to FIGS. 5A-5C, except with the door in a fully opened position.
Figure 6A:
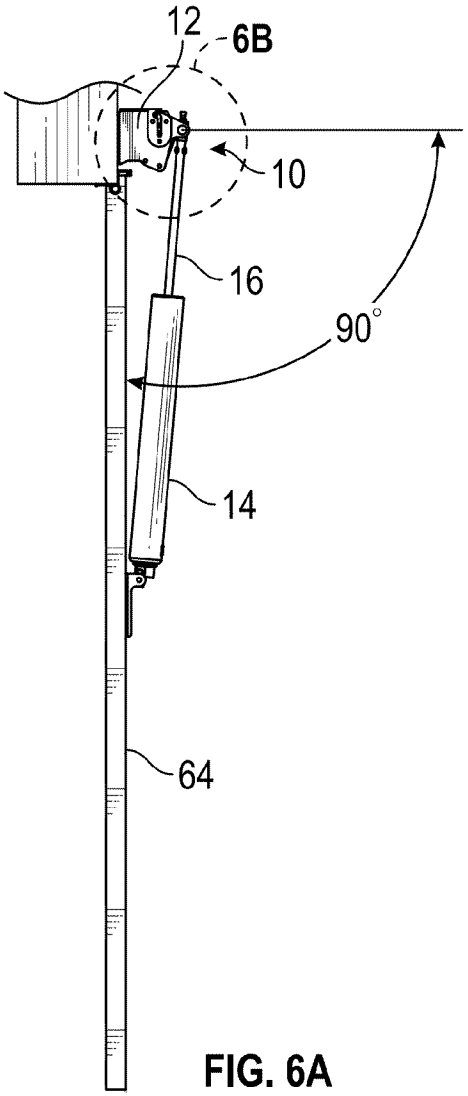
Figure 6C:
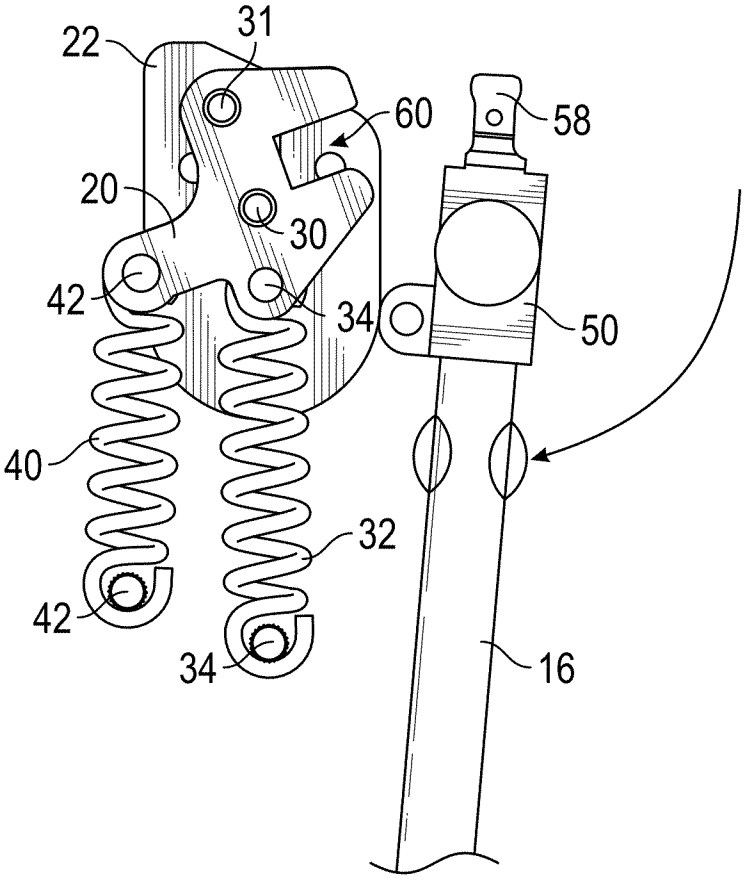

FIGS. 6A-6C show the door 64 in a fully open position, with the end 58 of the insert 50 completely disengaged from the cam switch 20 (FIG. 6C). The second spring 40 and the upper pin 31 in the head 29 of the slot 28 prevents the cam switch 20 from being pulled outwardly by the first spring 32 along the slot 28. The cam switch 20 is pivoted inwardly to an open position by the spring 40.

Figure 7A:
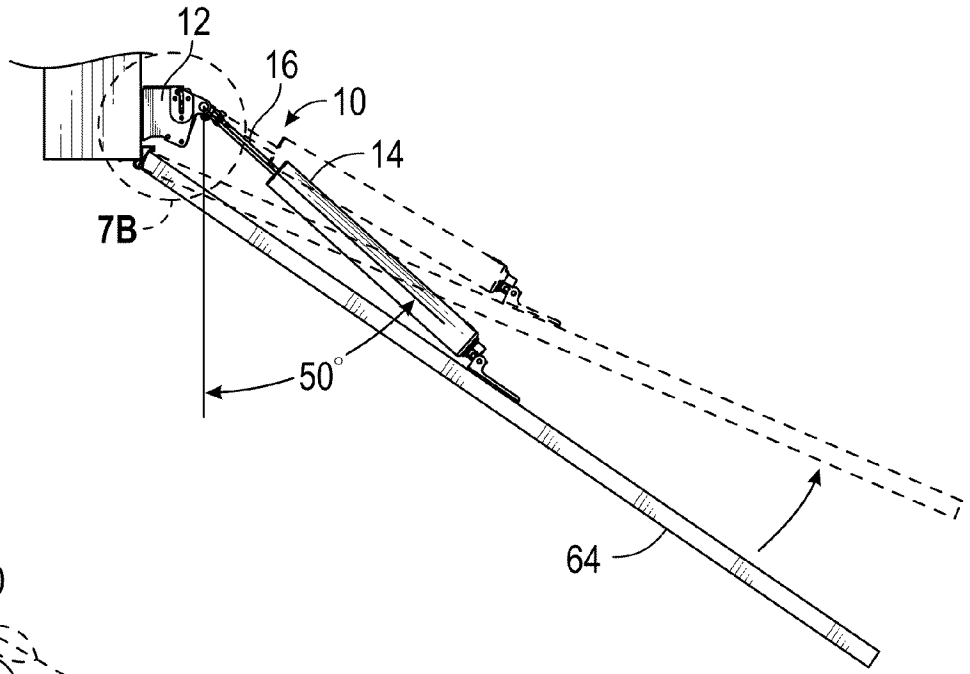
FIGS. 7A-7C are similar to FIGS. 6A-6C, except with the door in an initial closing position from the fully opened position, and with the broken lines showing continued closing of the door.
Figure 7B:
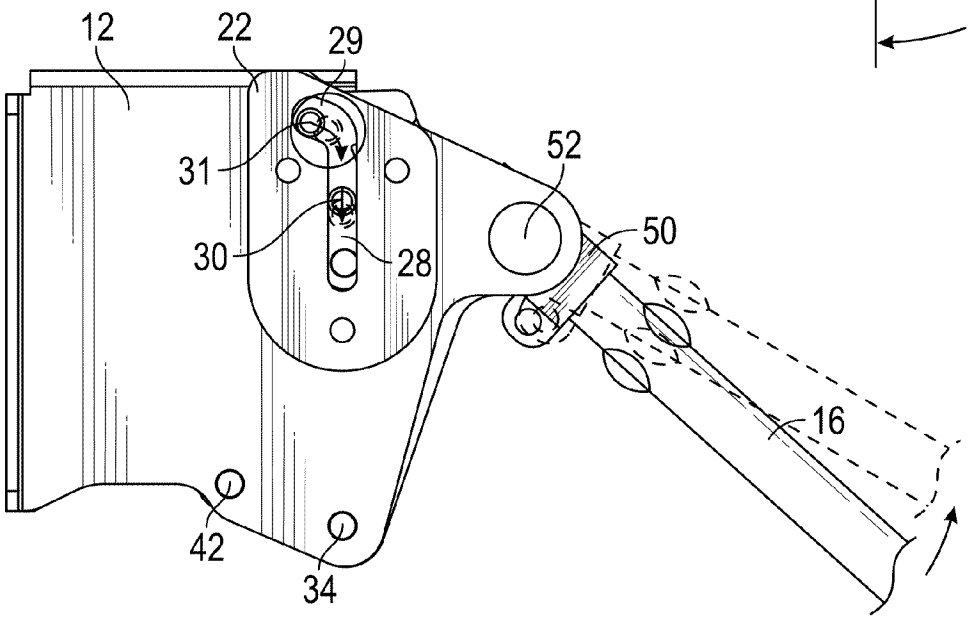
Figure 7C:
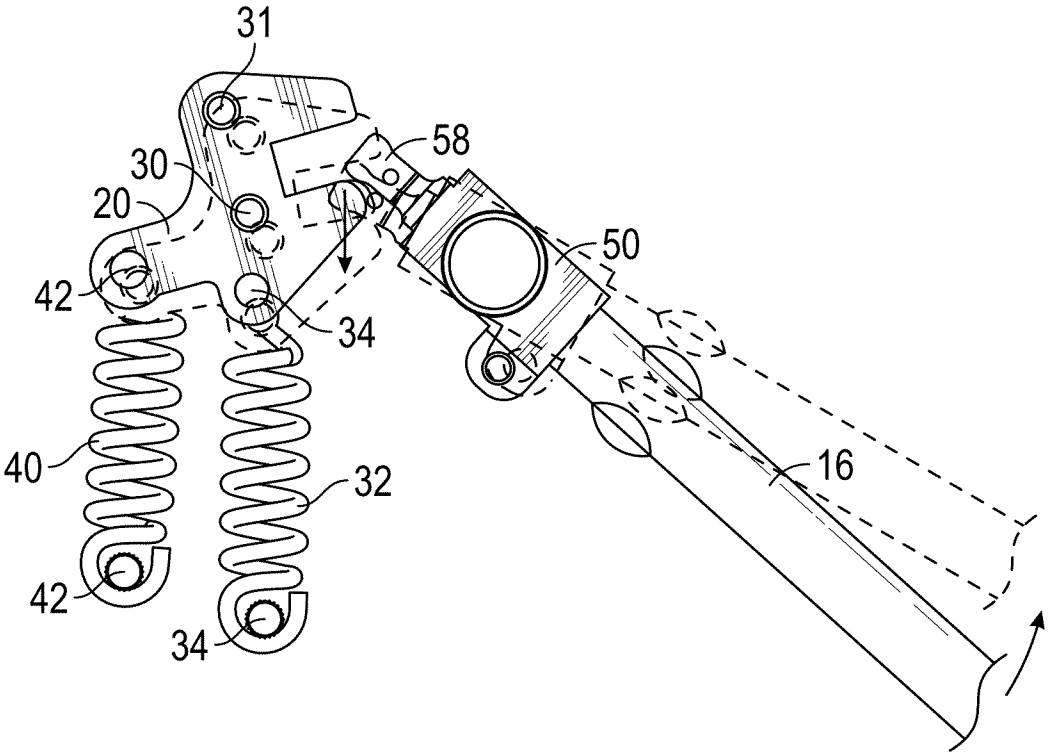
Figure 8A:
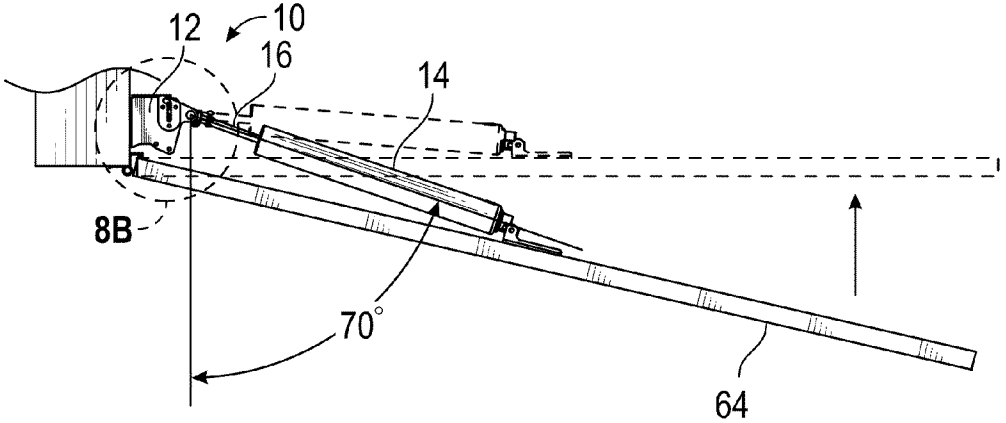
FIGS. 8A-8C are similar to FIGS. 7A-7C, except with the door in a further closed position, and broken lines showing the door in a fully closed position.
Figure 8B:
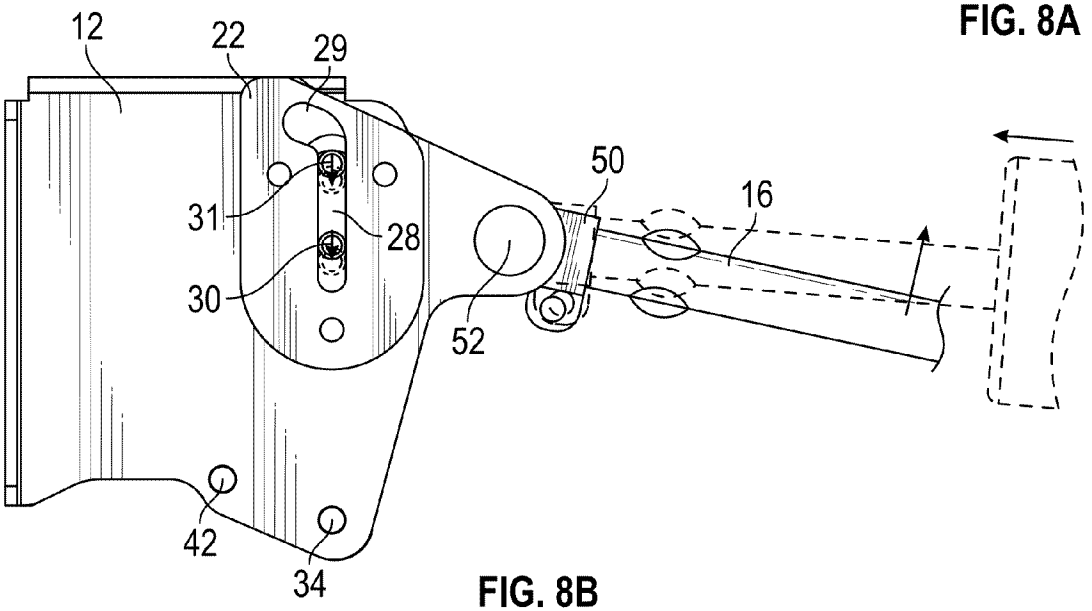
Figure 8C:
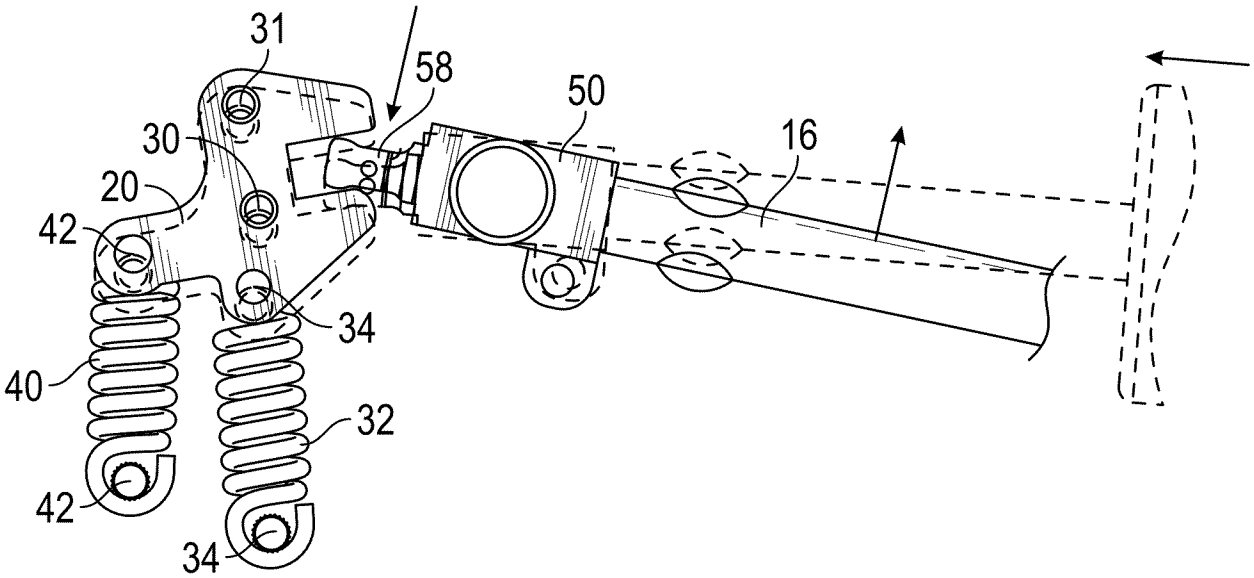

As the door 64 begins to close, as shown in FIGS. 7A-7C, the end 58 of the insert 50 is re-introduced into the notch 60 of the cam switch 20, thereby pivoting the cam switch 20 so that the spring 32 will pull the pins 30, 31 outwardly along the slot 28. As the door is nearing full closure, as shown in solid lines in FIGS. 8A-8C, the spring 32 pivots the cam switch 20 against the end 58 of the rod insert 50, thereby urging the door to a fully closed position, shown in broken lines in FIGS. 8A-8C. Thus, the outward linear movement of the cam plate 20 along the slots 28 via the spring 32 provides a pivotal force on the rod insert 50, rod 16 and cylinder 14 to automatically pull the door to the fully closed and sealed position, without user interaction.

Figure 9:
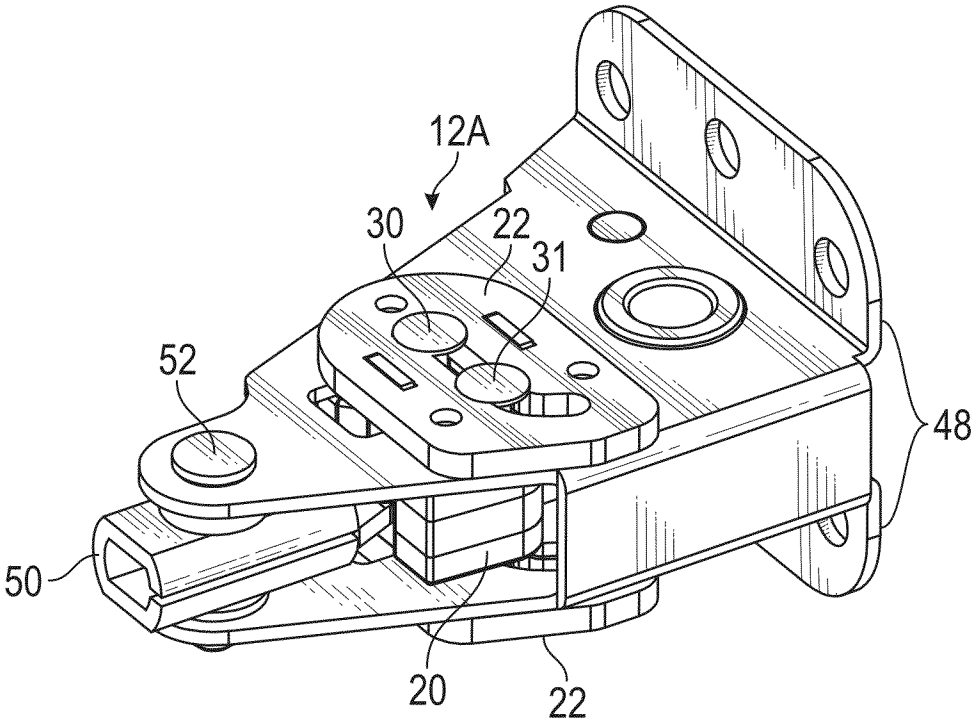
FIG. 9 is a perspective view of an alternative embodiment of the bracket door closer of the present invention.
Figure 10:
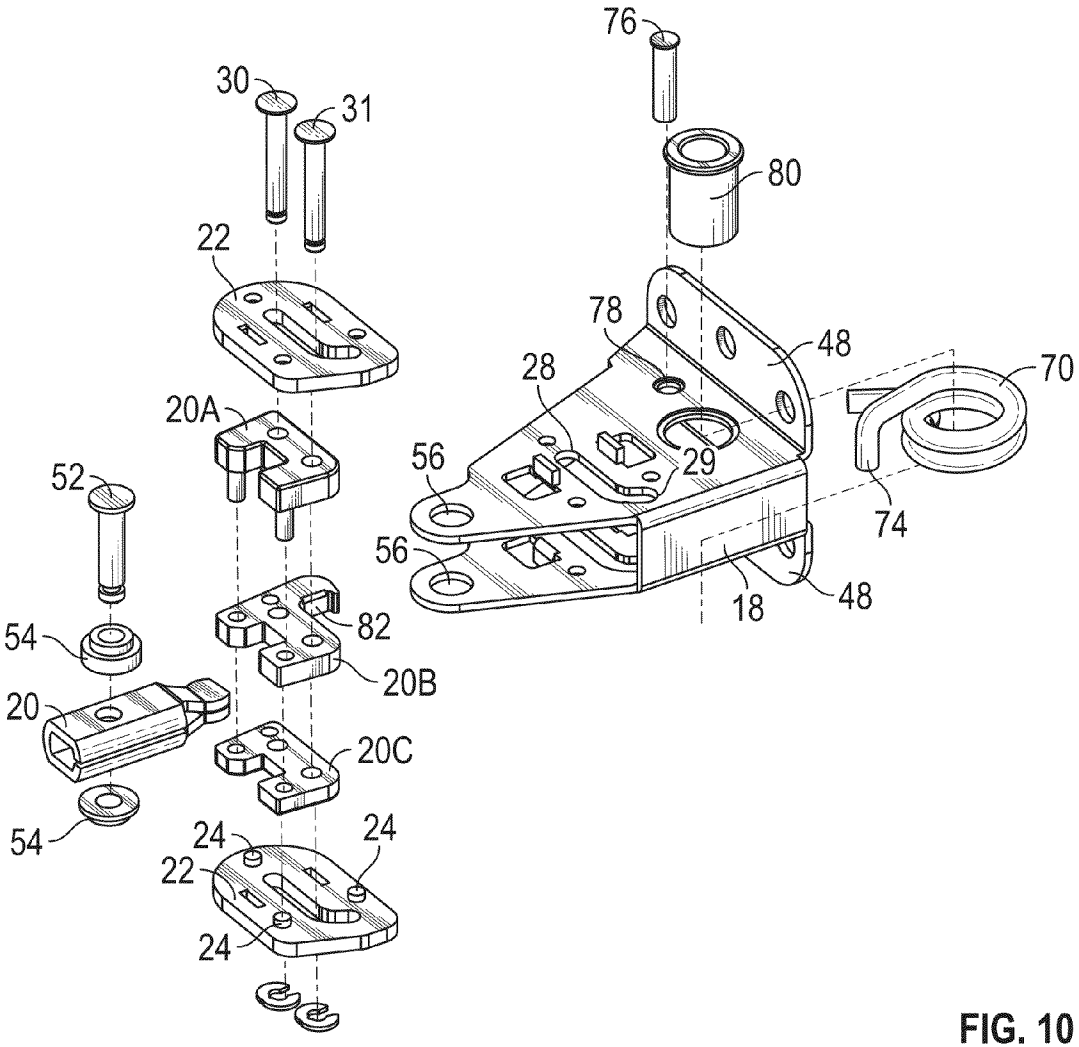
FIG. 10 is an exploded perspective view of the bracket door closer shown in FIG. 9.
Figure 11:
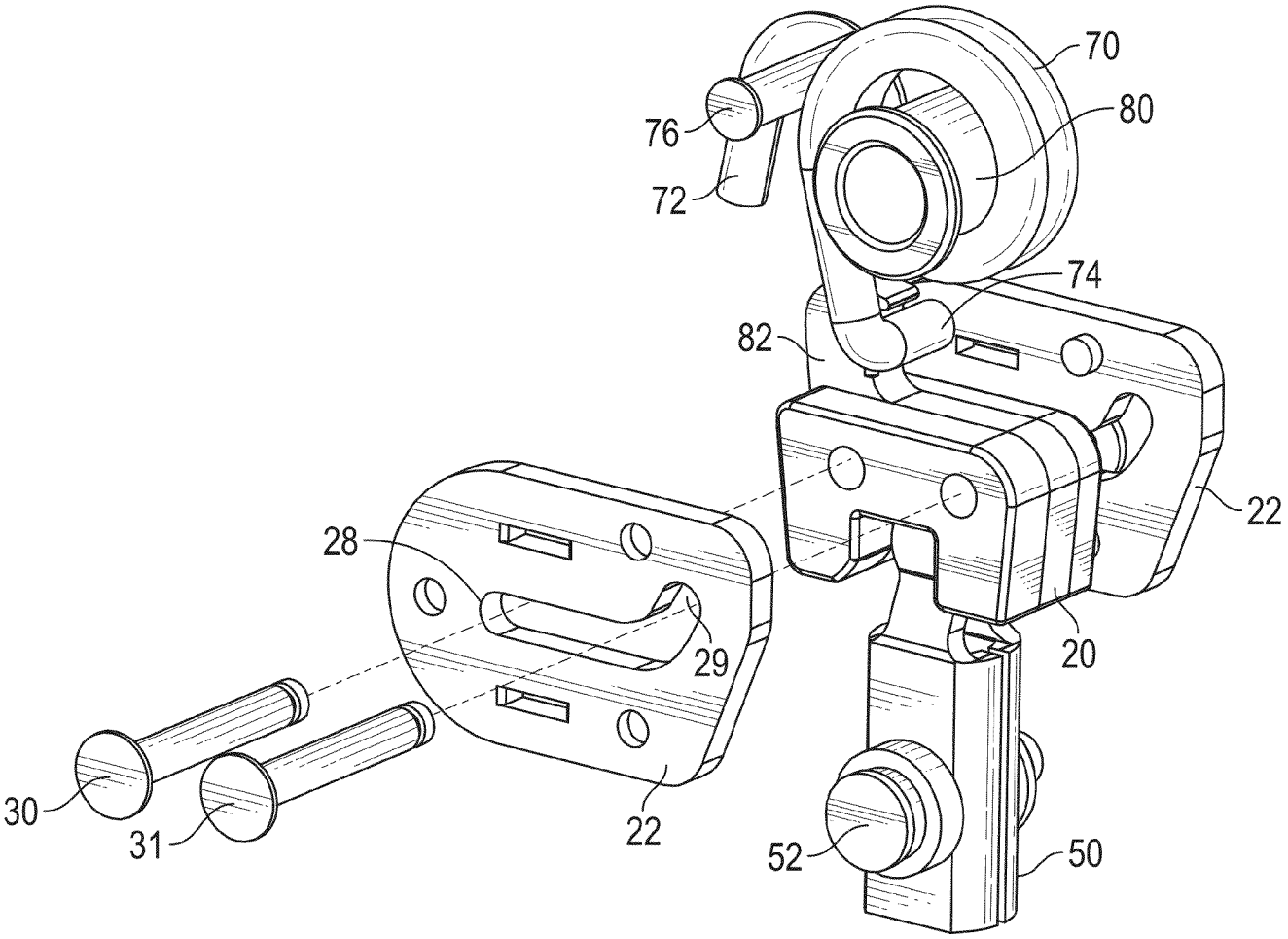
FIG. 11 is a partially exploded view of the cam switch, rod insert, and spring components of the embodiment shown in FIG. 9.

An alternative embodiment of the bracket door closer 12A is shown in FIGS. 9-11. The primary difference between the alternative embodiment 12A and the embodiment 12 shown in FIGS. 1-8 is the use of a torsion spring 70 in the alternative embodiment, rather than the compression springs 32, 40 in the first embodiment 12. Similar components are labeled with the same reference numerals in the alternative embodiment as in the first embodiment.

More particularly, the torsion spring 70 includes opposite ends 72, 74. The first end 72 is retained by a pin 76 extending through holes 78 in the bracket housing 18. A bushing 80 extends through the housing 18 and the center of the spring 70. The second end 74 of the spring 70 rests upon a lip or shelf 82 of the cam switch 20. As seen in FIG. 10, the cam switch 20 may be comprised of plates 20A, 20B, and 20C, with the center plate 20B being sandwiched between the outer plates 20A and 20C. The shelf 82 is formed on the center plate 20B. Alternatively, the cam switch can be formed as a one piece integral member.

The function of the alternative embodiment closer 12A is the same as the primary embodiment closer 12.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A door closer assembly for a storm or screen door movable between opened and closed positions relative to a door frame, comprising:

a bracket assembly:

the bracket assembly comprising a housing adapted to be fixed to the door frame, a cam switch mounted to the housing for movement relative to the housing, and a rod attached to the cam switch;

the housing having parallel spaced apart sides, with the cam switch movably sandwiched between the sides;

the cam switch having two springs, and each spring have a first end and a second end, the first end of each spring being attached to the housing, and the second end of each spring being attached to the cam switch;

whereby when the cam switch is moved relative to the housing, the two springs are compressed or extended;

the rod having a first end extending into the housing between the housing sides and a second end adapted for rotation about an axis;

the rod first end being connected to the cam switch;

a cylinder having a first end connected to the second end of the rod and having a second end adapted to be pivotally attached to the storm door;

whereby when the door is swung open and close, the rod rotates to urge the cam switch to slide within the housing sides between an open position and a close position respectively;

when the cam switch is in the open position, the two springs are extended; and when the door is closing, the two springs are retracted and apply a force on the rod to pull the cylinder to close the door.

2. The door closer assembly of claim 1 wherein the housing has a slot on both side housing sides, and each slot has a curve end and straight end.

3. The door closer assembly of claim 2 wherein the cam switch has two pins extended through each slot of the housing and attached to the cam switch to provide pivotal movement of the cam switch about the two pins.

4. The door closer assembly of claim 3 whereby when the cam switch is in the closed position, the two pins are all in the straight end of the slot of the housing and the two springs are compressed, and whereby when the cam switch is in the open position, one pin is in the curve end of the slot of the housing and the other pin is in the straight end of the slot of the housing, and the two springs are extended.

5. The door closer assembly of claim 4 wherein the cam switch is biased to the closed position by the first spring and is biased to the open position by the second spring.

6. The door closer assembly of claim 1 wherein the first and second springs extend between the bracket assembly and the cam switch.

7. The door closer assembly of claim 1 wherein the cam switch includes a notch to slidably receive the first end of the rod.

8. The door closer assembly of claim 7 wherein the rod engages the cam switch during opening and closing of the storm door, and the rod disengages the cam switch when the door is opened more than 40 degrees.

9. A door closer apparatus for a storm or screen door movable between opened and closed positions relative to a door frame, comprising:

a bracket assembly;

the bracket assembly comprising a housing, a cam switch, a torsion spring and a rod insert;

the housing being adapted for moveably mounting the cam switch on the fixed frame;

the housing having parallel spaced opposite sides, sandwiching the cam switch therebetween;

the torsion spring being mounted on the housing between the housing sides for rotation about an axis;

the spring having a first end and a second end, the first end of the spring being attached to the housing, and the second end of the spring engaging the cam switch;

whereby when the cam switch is movable relative to the housing to an open position, the spring is rotated and the stress on the spring is increased;

the rod insert having a first end extending into the housing between the bracket arms and a second end adapted for rotation about an axis;

the first end of the rod insert being connected to the cam switch;

cylinder having a first end connected to the second end of the rod insert and having a second end adapted to be attached to the storm door;

whereby when the door is swung open and close the rod insert rotates, and whereby when the door is swung, the rod insert urges the cam switch to slide within the bracket to move the cam switch between an open position and a close position; and whereby when the cam switch is in the open position, the stress of the spring are biggest, and whereby when the door is closing, the spring is released and applies a force to the rod to pull the cylinder to close the door.

10. The door closer assembly of claim 9 wherein the housing has an "L" shaped slot on both of the bracket arms, and each slot has a curved end and a straight end.

11. The door closer assembly of claim 10 wherein the cam switch has two pins extended through each slot of the housing and attached on the cam switch to provide pivotal movement of the cam switch about the two pins.

12. The door closer assembly of claim 11 whereby when the cam switch is in closed position, the two pins are all in the straight end of the slot of said housing, whereby when the cam switch is in open position, one of the pins is in the curve end of the slot of the housing and the other pin is in the straight end of the slot of said housing, then the stress of the spring is biggest.

13. The door closer assembly of claim 9 wherein the cam switch has a shelf and the second end of the spring rests upon said shelf.

14. The door closer assembly of claim 13 wherein the cam switch is biased to a closed position by the spring and is biased to an open position by the spring.

15. The door closer assembly of claim 9 wherein the cam switch includes a notch to slidably receive the first end of the rod insert.

16. The door closer assembly of claim 15 wherein the rod insert engages the cam switch during opening and closing of the storm door, and the rod insert disengages the cam switch when the door is opened more than 40 degrees, to reduce a force required to open the door.

* * * * *